US006272708B1

(12) United States Patent
Chen

(10) Patent No.: US 6,272,708 B1
(45) Date of Patent: Aug. 14, 2001

(54) SCRAPER KIT FOR MASONS

(76) Inventor: Martin Chen, P.O. Box 63-247, Taichung (TW)

( * ) Notice: Subject to any disclaimer, the term of this patent is extended or adjusted under 35 U.S.C. 154(b) by 0 days.

(21) Appl. No.: 09/524,981

(22) Filed: Mar. 14, 2000

(51) Int. Cl.[7] ..... A46B 7/00

(52) U.S. Cl. ..... 7/105; 7/165; 30/169; 15/236.01

(58) Field of Search ..... 7/105, 100, 138, 7/143, 165; 81/490; 15/236.01, 145; 30/169

(56) References Cited

U.S. PATENT DOCUMENTS 5,161,278 * 11/1992 Tomm ..... 15/159.1
5,546,625 * 8/1996 Mealey, Sr. ..... 15/105
5,566,596 * 10/1996 Lin ..... 81/490
5,575,030 * 11/1996 Girard ..... 15/105
5,613,413 * 3/1997 Huang ..... 81/490
5,720,063 * 2/1998 Chacon ..... 7/165
5,868,048 * 2/1999 Cassutti et al. ..... 81/439
5,881,615 * 3/1999 Dahl et al. ..... 81/490
5,957,014 * 9/1999 Tseng et al. ..... 81/439
6,009,581 * 1/2000 Davis et al. ..... 7/105
6,131,222 * 10/2000 Anderson et al. ..... 7/105
6,131,290 * 10/2000 Chiou ..... 30/169

* cited by examiner

*Primary Examiner*—James G. Smith
*Assistant Examiner*—Hadi Shakeri
(74) *Attorney, Agent, or Firm*—Rosenberg, Klein & Lee

(57) ABSTRACT

A mason's scraper kit that has an extension rod and a scraper that can be easily engaged with or disengaged from an end of the extension rod. The scraper includes a handle with a receptacle. The receptacle includes a first threaded section in an inner end thereof and a second threaded section in an outer end thereof. The end of the extension rod includes a first outer threading for engaging with the first threaded section of the receptacle of the scraper handle. The end of the extension rod further includes a second outer threading for engaging with the second threaded section of the receptacle of the scraper handle. An end block is removably mounted in a handle thereof for carrying at least one tool bit. The end block includes a tool-engaging hole for releasably engaging with a tool bit, thereby providing an additional function.

13 Claims, 10 Drawing Sheets

SCRAPER KIT FOR MASONS

BACKGROUND OF THE INVENTION

1. Field of the Invention

The present invention relates to a scraper kit for masons, and more particularly to a scraper kit for masons including an extension rod and a scraper that can be attached to an end of the extension rod for removing redundant cement on high. The present invention also relates to a scraper that may carry an end block in a handle thereof and a plurality of tool bits are carried by the end block.

2. Description of the Related Art

FIG. 9 of the drawings illustrates a conventional handle of a mason's scraper. The scraper handle 50 is threadedly engaged with a threaded end 52 of an extension rod 51 for removing cement on high. Nevertheless, the length L1 of the threaded end 52 is too short such that the threaded end 52 tends to break or disengage from the handle 50 during use, as the extension rod 51 has a considerable length. A solution to this problem is shown in FIG. 10, wherein the threaded end 52 and corresponding threaded section of the scraper handle 50 are lengthened (see "L2"), yet the threading engagement/disengagement becomes time-consuming and inconvenient.

SUMMARY OF THE INVENTION

It is a primary object of the present invention to provide a mason's scraper kit that has an extension rod and a scraper that can be easily engaged with or disengaged from an end of the extension rod. The scraper includes a handle with a receptacle. The receptacle includes a first threaded section in an inner end thereof and a second threaded section in an outer end thereof. The end of the extension rod includes a first outer threading for engaging with the first threaded section of the receptacle of the scraper handle. The end of the extension rod further includes a second outer threading for engaging with the second threaded section of the receptacle of the scraper handle. Thus, engagement/disengagement of the scraper handle with/from the end of the extension rod can be easily achieved.

It is another object of the present invention to provide a mason's scraper that has an end block removably mounted in a handle thereof and a plurality of tool bits are carried by the end block. The end block includes a tool-engaging hole for releasably engaging with a tool bit, thereby providing an additional function.

It is a further of the present invention to provide a mason's scraper that has an anti-slip section on a handle thereof to prevent skip of user's finger during use.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
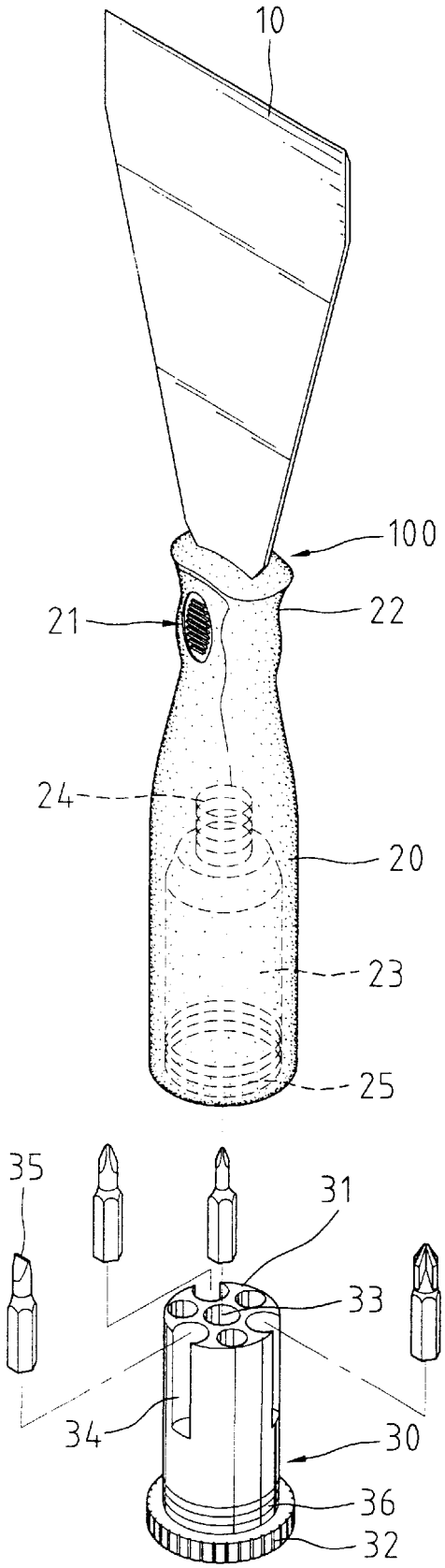
FIG. 1 is an exploded perspective view of a mason's scraper in accordance with the present invention.
Figure 2:
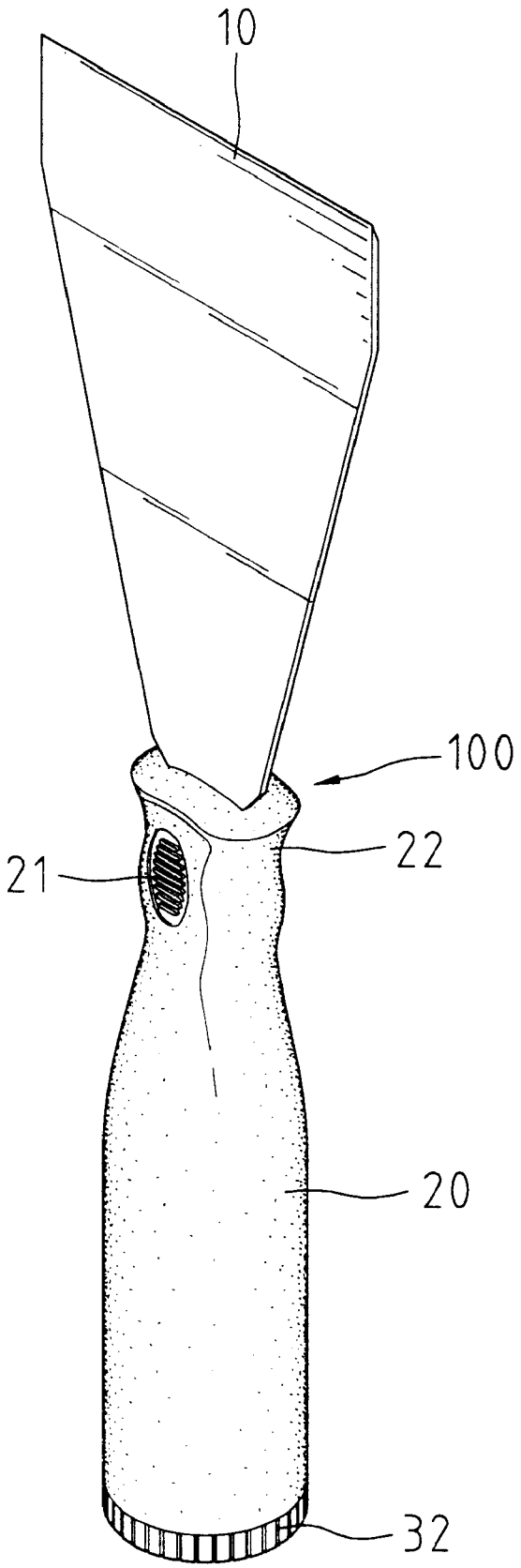
FIG. 2 is a perspective view of the mason's scraper in accordance with the present invention.

Referring to FIGS. 1 and 2, a mason's scraper 100 in accordance with the present invention generally includes a handle 20 and a blade 10 attached to an end of the handle 20. A recessed anti-skip portion 21 is provided on the handle 20 at a position adjacent to the blade 10 such that the user's finger (e.g., the thumb 201, FIG. 3) may apply a force to the recessed anti-skip portion 21 when in use. The handle 20 includes a receptacle 23 that has a first threaded section 24 in an inner end thereof and a second threaded section 25 in an outer end thereof.

Figure 5:
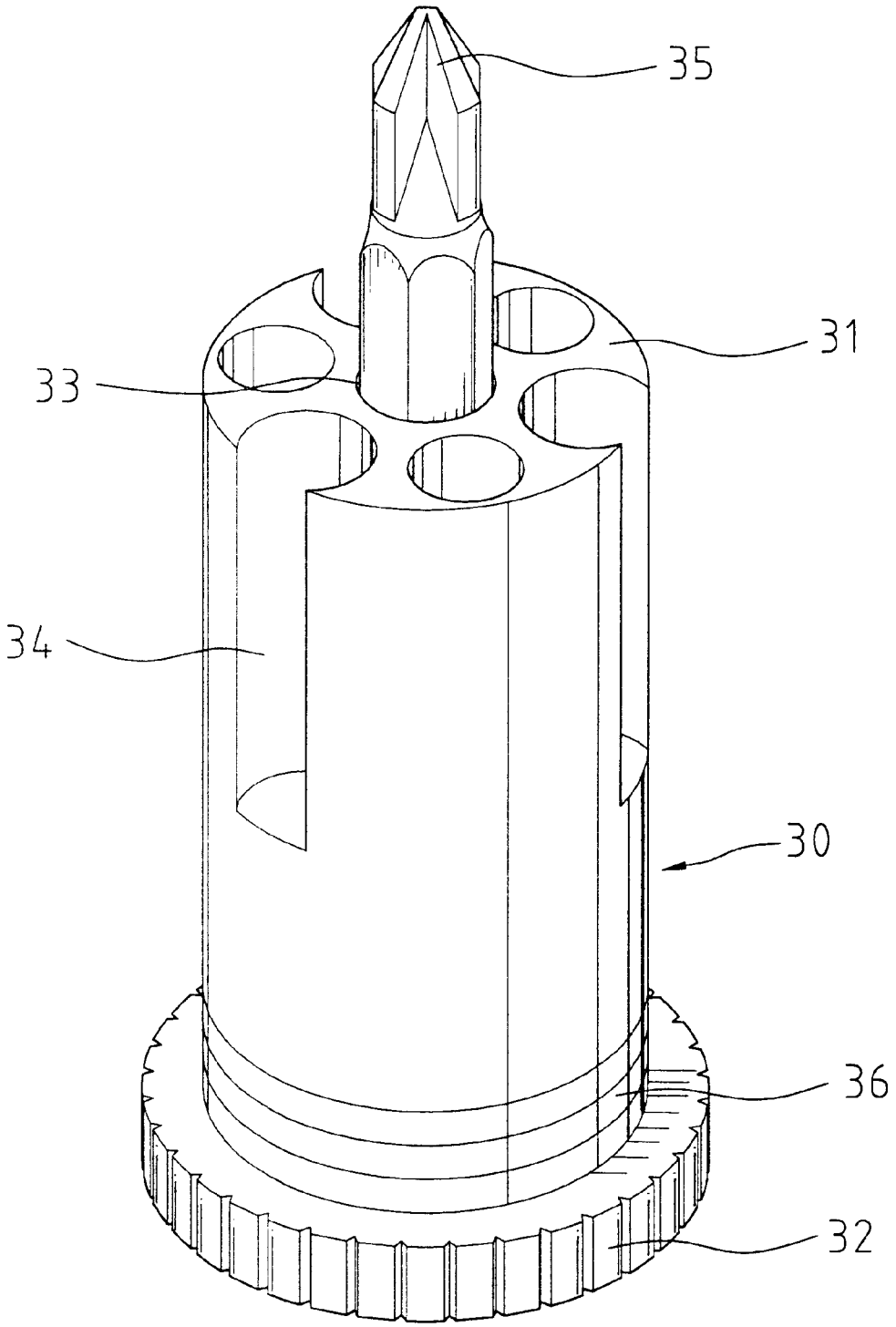
FIG. 5 is a perspective view illustrating use of an end block of the mason's scraper in accordance with the present invention.

An end block 30 is removably mounted in the receptacle 23 of the handle 20. The end block 30 includes a tool seat 31 and a hammer section 32 formed on an end of the tool seat 31. The tool seat 31 includes a tool-engaging hole 33 on an end face of the other end thereof for releasably receiving a tool bit 35. The tool-engaging hole 33 is preferably defined in a center of the tool seat 31. The end face of the other end of the tool seat 31 further includes a plurality of grooves 34 for receiving different bits 35. Preferably, the grooves 34 surround the central tool-engaging hole 33. Thus, the end block 30 can be used as a screwdriver or the like, best shown in FIG. 5. The tool seat 31 includes an outer threading 36 adjacent to the hammer section 32. Thus, the end block 30 may be received in the receptacle 23 of the handle 20 with the outer threading 36 engaged with the second threaded section 25 of the receptacle 23.

Figure 3:
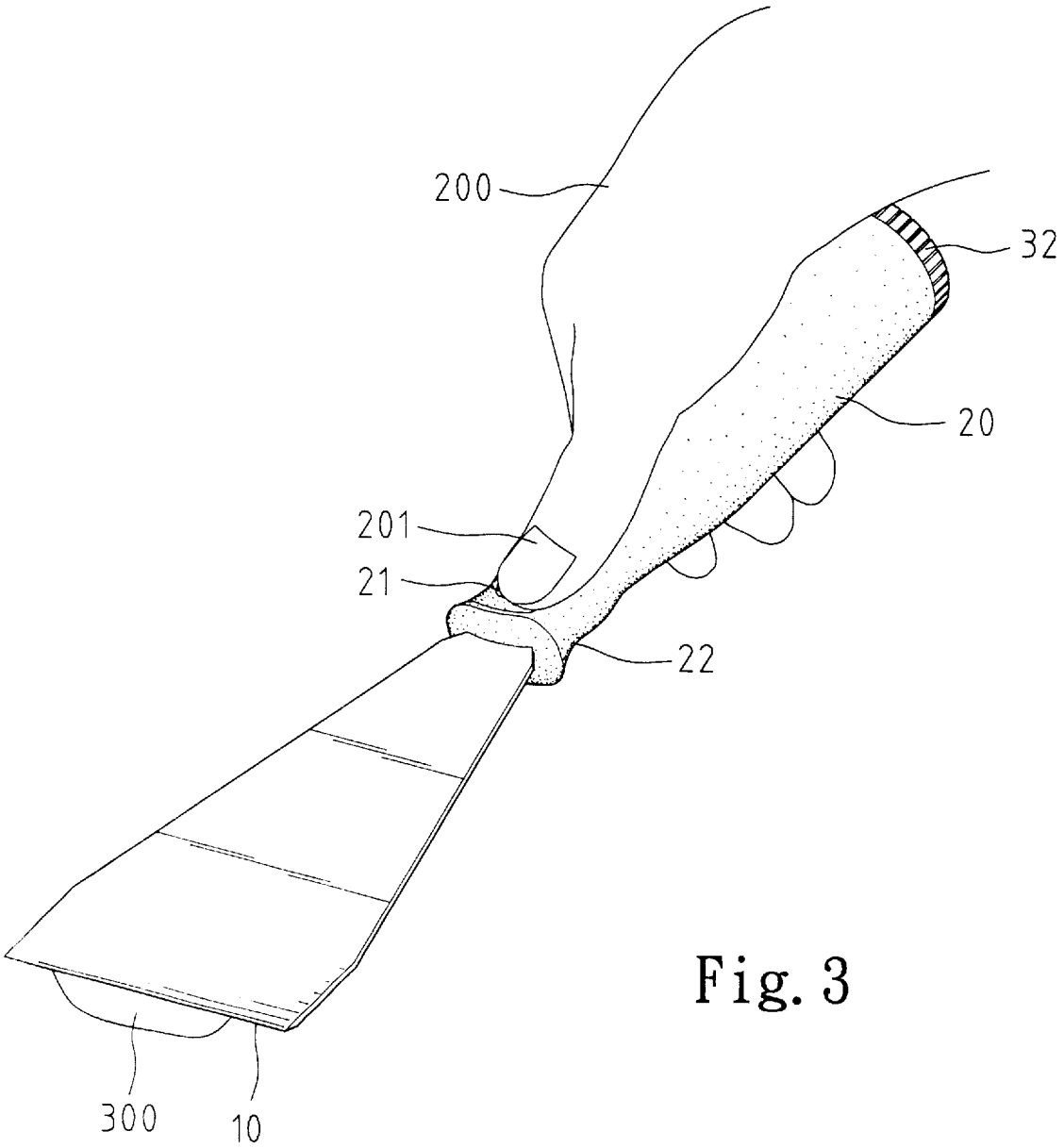
FIG. 3 is a perspective view illustrating use of the mason's scraper in accordance with the present invention.
Figure 4:
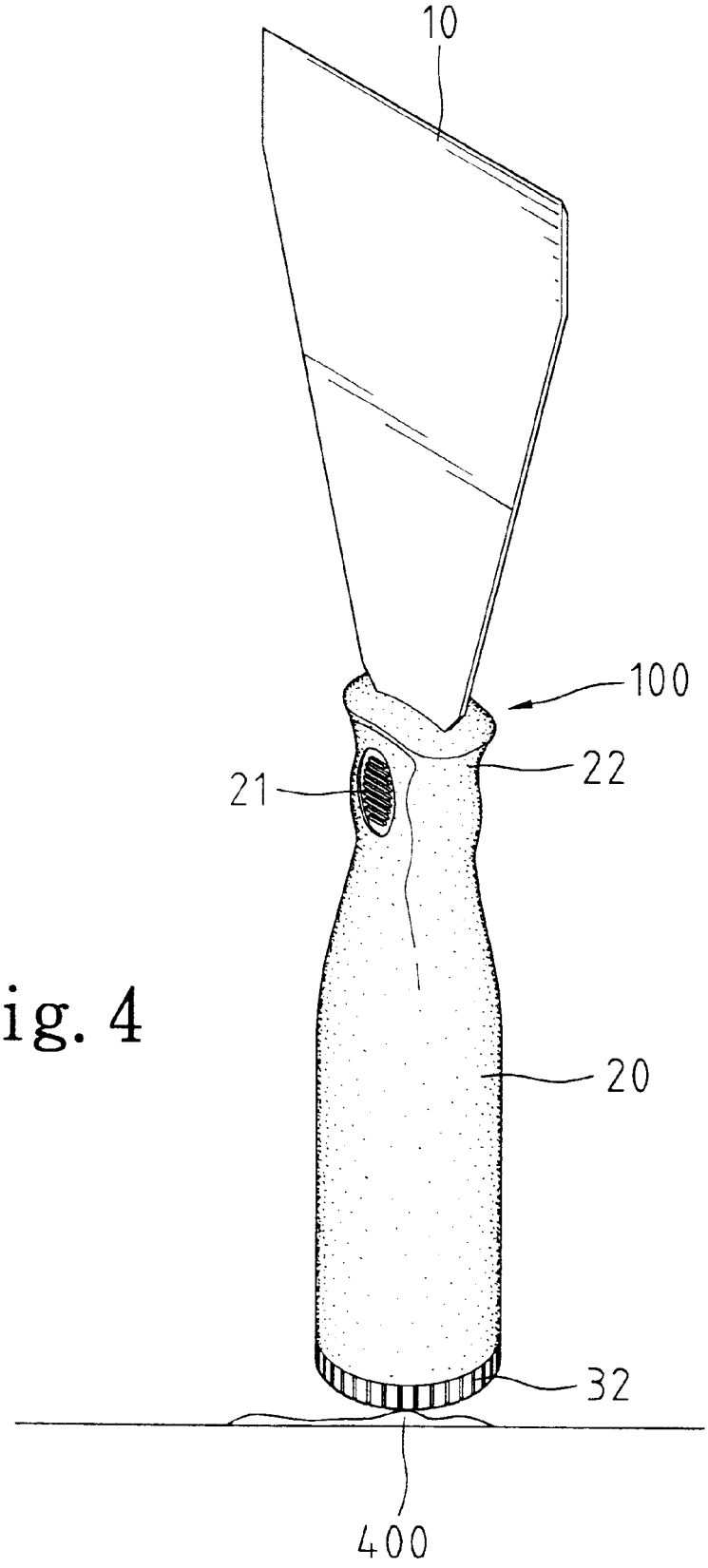
FIG. 4 is a perspective view illustrating another use of the mason's scraper in accordance with the present invention.

FIG. 3 illustrates use of the mason's scraper in accordance with the present invention, wherein the thumb 201 of the user's hand 200 is placed on the recessed anti-skip section 21 on the handle 20 to prevent undesired skip during use. Thus, the user may use the blade 10 of the scraper 100 to remove redundant cement 300. FIG. 4 illustrates another use of the mason's scraper, wherein the user may use the hammer section 32 to break hardened cement 400. The hammer section 32 is made of rigid material, e.g., metal.

Figure 6:
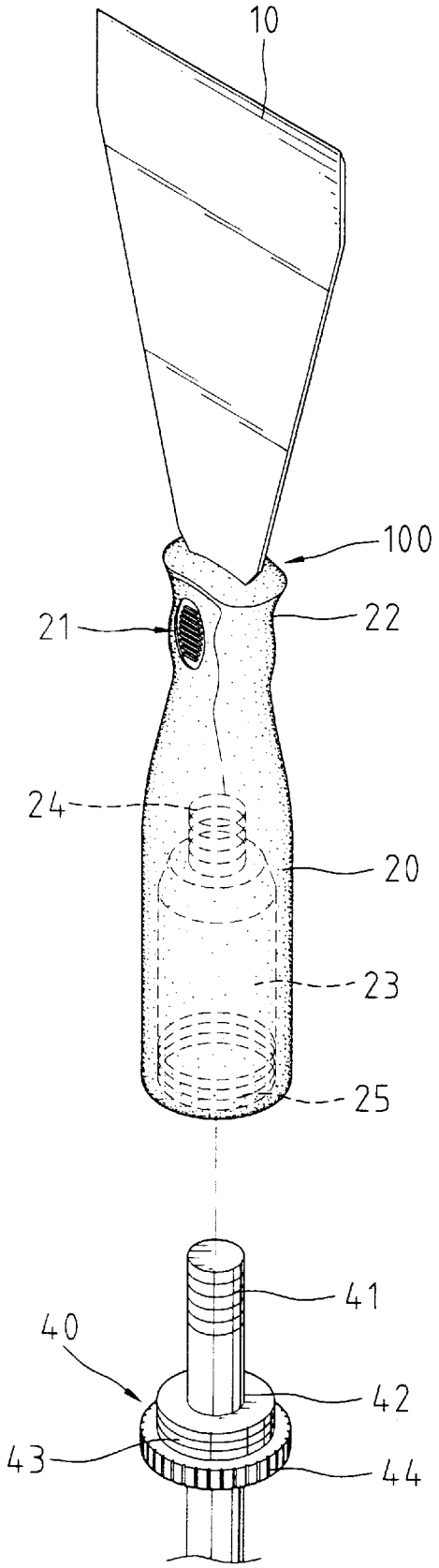
FIG. 6 is an exploded perspective view illustrating a scraper kit in accordance with the present invention.
Figure 7:
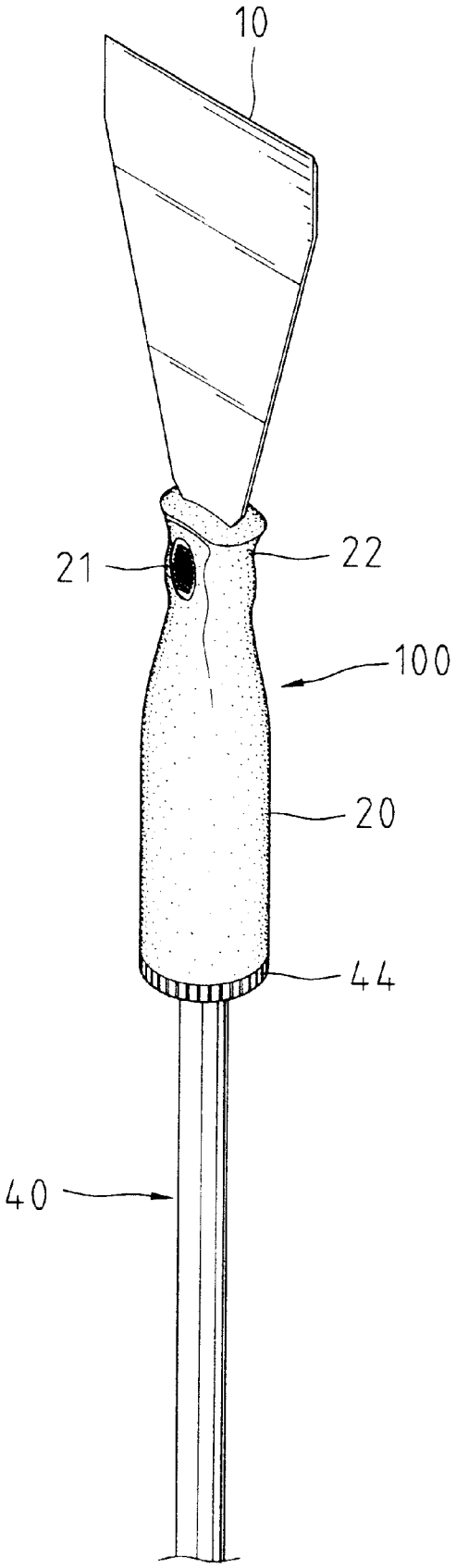
FIG. 7 is a perspective view of the mason's scraper kit in accordance with the present invention.
Figure 8:
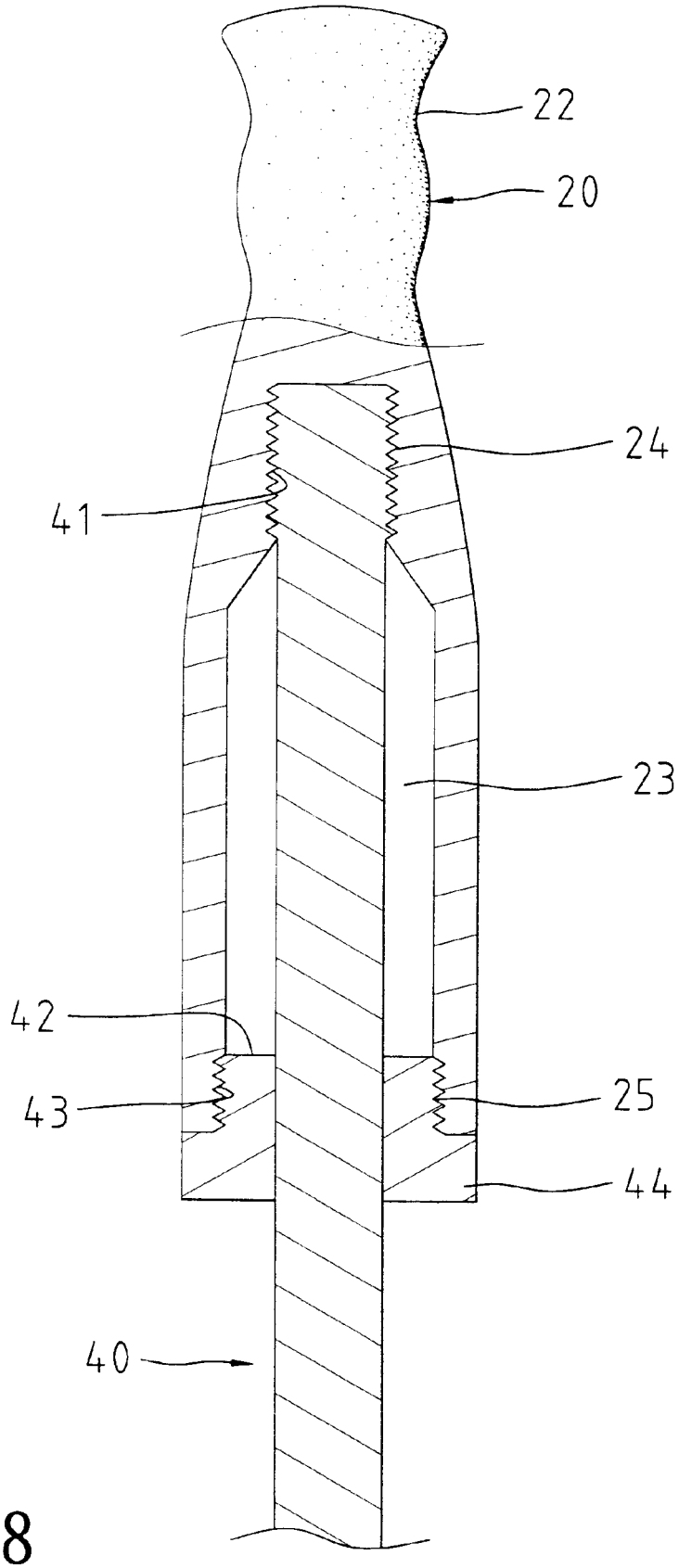
FIG. 8 is a sectional view, in an enlarged scale, illustrating engagement between the mason's scraper and the extension rod of the scraper kit in accordance with the present invention.
Figure 9:
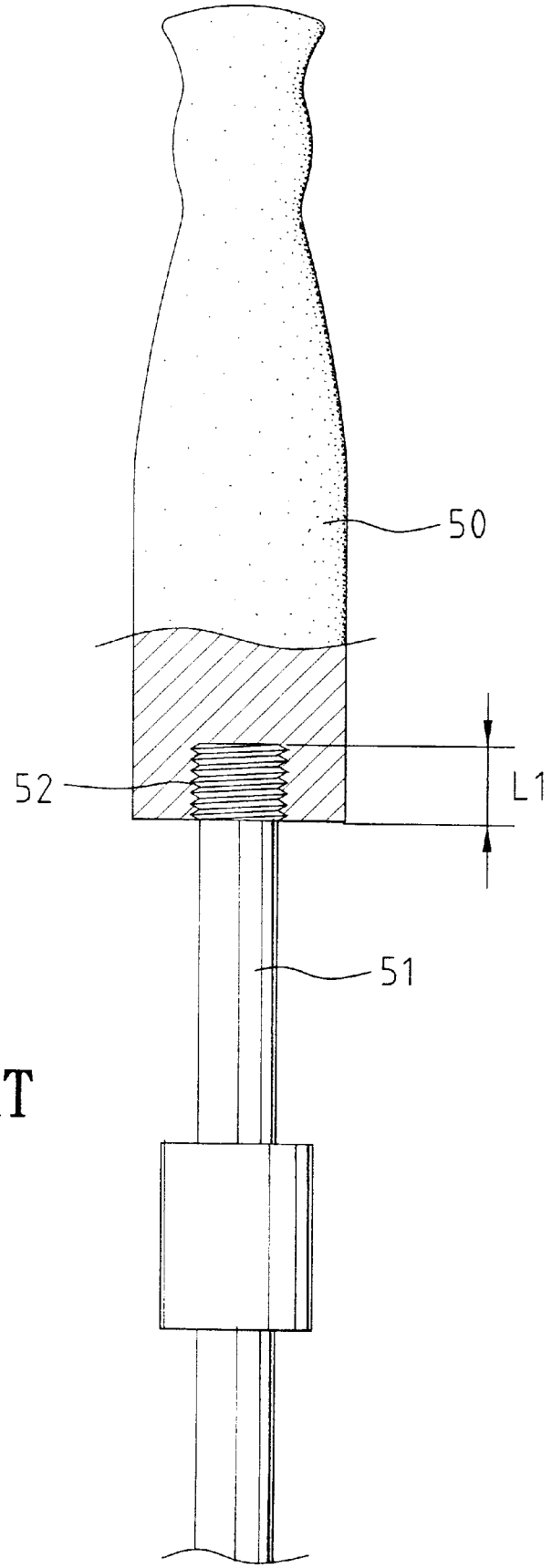
Fig. 9 PRIOR ART
FIG. 9 is a sectional view illustrating engagement between a conventional mason's scraper and an extension rod.
Figure 10:
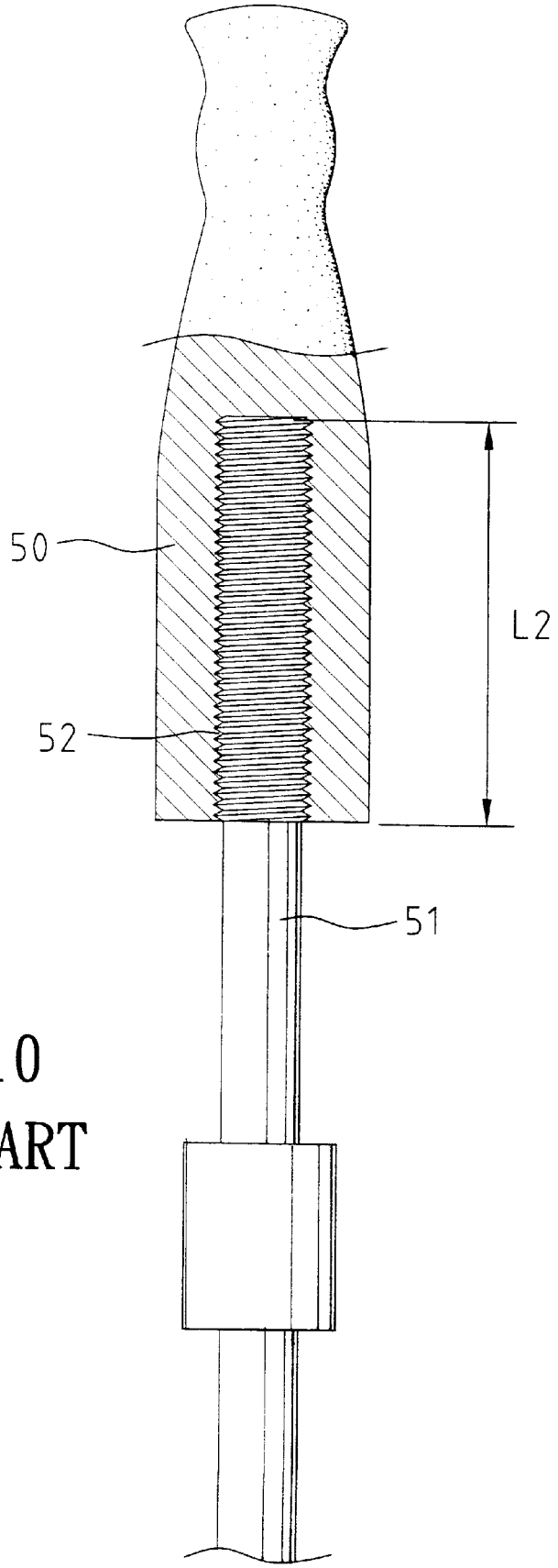
Fig. 10 PRIOR ART
FIG. 10 is a sectional view illustrating another engagement between a conventional mason's scraper and an extension rod.

Turning to FIG. 6, when removing cement on high that is not reachable by hand, the scraper in accordance with the present invention may be attached to an end of an extension bar 40. As illustrated in FIGS. 6 through 8, the end of the extension rod 40 includes a first outer threading 41 for engaging with the first threaded section 24 of the receptacle 23 of the scraper handle 20. The end of the extension rod 40 further includes a second outer threading 43 for engaging with the second threaded section 25 of the receptacle 23 of the scraper handle 20. In this embodiment, the second outer threading 43 is formed on an outer periphery of a stub 42 projected from a side of an end cap 44. The end cap 44 has a hole (not labeled) and thus slidable along the extension rod 44. The end cap 44 covers the receptacle 23 of the handle 20 when the handle 20 is attached to the end of the extension rod 40. Thus, engagement/disengagement of the scraper handle 20 with/from the end of the extension rod 40 can be easily achieved, as the threaded sections 24, 25 are shorter than those of conventional design.

According to the above description, it is appreciated that the mason's scraper in accordance with the present invention may remove redundant cement without the risk of skip during use by means of provision of the anti-skip section on the handle. In addition, the hammer section on the end block securely received in the handle may be used to break hardened cement. Furthermore, the end block may be removed and the handle is attached to an end of an extension rod so as to remove cement on high. The threading engagement between the extension rod and the handle is reliable to prevent breakage in the engaging area, yet the engagement/disengagement is easier.

Although the invention has been explained in relation to its preferred embodiment, it is to be understood that many other possible modifications and variations can be made without departing from the spirit and scope of the invention as hereinafter claimed.

What is claimed is:

1. A scraper comprising:

a handle and a blade attached to an end of the handle, the handle including a receptacle, and an end block removably mounted in the receptacle of the handle, the end block being capable of carrying at least one tool bit, the end block being removed from the receptacle of the handle when using as a screwdriver.

2. The scraper kit as claimed in claim 1, wherein the handle includes an anti-skip section adjacent to the blade for preventing skip of use's finger during use.

3. The scraper kit as claimed in claim 1, further comprising an end block that is removably mounted in the receptacle of the handle after disengaging the extension rod from the handle, the end block including an outer threading for releasably engaging with the second threaded section of the receptacle.

4. The scraper kit as claimed in claim 3, wherein the end block includes a hammer section located outside the handle when the end block is received in the receptacle of the handle.

5. The scraper kit as claimed in claim 3, wherein the end block includes a tool seat with an end face, the end face having a tool-engaging hole for releasably receiving a tool bit.

6. The scraper kit as claimed in claim 5, wherein the tool-engaging hole is located in a center of the end face.

7. The scraper kit as claimed in claim 5, wherein the end face of the tool seat includes a plurality of grooves for receiving different bits.

8. The scraper kit as claimed in claim 6, wherein the end face of the tool seat includes a plurality of grooves surrounding the tool-engaging hole for receiving different bits.

9. A scraper kit comprising:

a handle and a blade attached to an end of the handle, the handle including a receptacle, the receptacle including a first threaded section in an inner end thereof and a second threaded section in an outer end thereof; and an extension rod including an end having a first outer threading for releasably engaging with the first threaded section of the receptacle, an end cap being slidably mounted to the end of the extension rod, the end cap including a second outer threading for releasably engaging with the second threaded section of the receptacle.

10. The scraper kit as claimed in claim 9, wherein the end cap includes a stub having an outer periphery on which the second outer threading is formed.

11. The scraper kit as claimed in claim 9, further comprising an end block that is removably mounted in the receptacle of the handle after disengaging the extension rod from the handle, the end block including an outer threading for releasably engaging with the second threaded section of the receptacle.

12. The scraper kit as claimed in claim 11, wherein the end block includes a hammer section located outside the handle when the end block is received in the receptacle of the handle.

13. The scraper kit as claimed in claim 11, wherein the end block includes a tool seat with an end face, the end face having a tool-engaging hole for releasably receiving a tool bit.

* * * * *